US006260299B1

(12) United States Patent
Jordan

(10) Patent No.: US 6,260,299 B1
(45) Date of Patent: Jul. 17, 2001

(54) FIREARMS SECURITY DEVICE AND SYSTEM

(76) Inventor: Albert Raymond Jordan, Belmont, Oldbury, Bridgnorth, Shropshire, WV16 SEH (GB)

( * ) Notice: Subject to any disclaimer, the term of this patent is extended or adjusted under 35 U.S.C. 154(b) by 0 days.

(21) Appl. No.: 09/247,711

(22) Filed: Feb. 9, 1999

(30) Foreign Application Priority Data

May 15, 1998 (GB) ..... 9810308

(51) Int. Cl.[7] ..... F41C 23/00
(52) U.S. Cl. ..... 42/70.11; 42/70.07
(58) Field of Search ..... 42/70.01, 70.06, 42/70.07, 70.11

(56) References Cited

U.S. PATENT DOCUMENTS 5,621,996 * 4/1997 Mowl, Jr. ..... 42/70.07
5,680,723 * 10/1997 Ruiz ..... 42/70.07
5,768,819 * 6/1998 Neal ..... 42/70.07

* cited by examiner

*Primary Examiner*—J. Woodrow Eldred
(74) *Attorney, Agent, or Firm*—Reinarrt, Boerner, Van Deuren, Norris & Rieselbach, s.c.

(57) ABSTRACT

A device for retaining a firearm in a secure and tamper-proof condition comprises a first member adapted to be attached to a substrate (e.g. a surface of a building or of a motor-vehicle), a second member adapted to engage the first member so that said first and second members define between them a cavity to receive a firearm and locking means adapted to lock together said first and second members so that the firearm is retained in the cavity. Preferably, the second member is adapted to be lockably secured to the firearm so as to prevent unauthorised use of the firearm during transit. The invention further provides a firearms security system comprising at least one of said devices.

19 Claims, 5 Drawing Sheets

FIREARMS SECURITY DEVICE AND SYSTEM

This invention relates to a firearms security device and to a system including one or more such devices.

Most countries have legislation relating to the ownership and use of firearms, as well as regulations concerning the secure and tamper-proof storage of firearms when not in use. However, such devices for securing firearms as are currently available have tended to rely on the physical attachment of a firearm to a substrate by means of a chain-and-lock (or cable-and-lock assembly), or by means of a hinged lockable clamp, or merely by placing the firearm inside a lockable cupboard or safe. Furthermore, the presently-available devices do not address the problem of securing firearms during transit, for example between an owner's residence and his motor vehicle and/or between the motor vehicle and a gun-club premises.

The applicant has now provided a device for securing firearms whereby a firearm can be kept in a secure and tamper-proof condition at all times.

The applicant has also provided a firearms security system including one or more devices according to the present invention.

Accordingly, in a first aspect the present invention provides a retention device for a firearm, the device comprising:

(a) a first member adapted, in use, to be substantially permanently attached to a substrate;

(b) a second member adapted, in use, to be operatively engageable with the first member, whereby the said first and second members define between them a cavity to receive the firearm;

(c) locking means adapted, in use, to lock together the said first and second members, whereby the firearm is retained in the cavity.

In a second aspect, the present invention provides a firearms security system including one or more of the devices described in the immediately-preceding paragraph.

In a device according to the first aspect of the present invention, the first member (a) and the second member (b) may each consist essentially of a sheet of a rigid material having, on one face thereof, a recess adapted to receive at least part of the firearm, whereby, when the first member (a) is in operative engagement with the second member (b), the said recesses co-operate to define the cavity to receive the firearm.

Preferably, the first member (a) may be provided with one or more locating pins and the second member (b) may be provided with one or more corresponding apertures to receive said pins when the first member (a) and the second member (b) are in operative engagement.

Alternatively, the second member (b) may be provided with one or more locating pins and the first member (a) may be provided with one or more corresponding apertures to receive said pins when the first member (a) and the second member (b) are in operative engagement.

The locating pins act to prevent the first and second members from being moved apart in a plane parallel to that of their faces and thus the pins enhance the effective security of the device.

One of the locating pins may be adapted, in use, to function as a trigger-guard for the firearm.

Any one or more of the locating pins may comprise a "latch-pin" of the type known to those skilled in the relevant art.

Alternatively, one or more "latch-pins" and corresponding apertures may be provided in addition to the locating pins to further enhance the effective security of the device.

The device may be provided with means, additional to the locking means (c), adapted, in use, to secure the firearm to the second member (b). Thus, the firearm can be moved from one fixed first member (a) to a second fixed first member (a) with the second member (b) secured in position, thus minimising the possibility of unauthorised use of the firearm during transfer from one location to another.

The first member (a) and second member (b) may suitably be provided with a mortice or other aperture to receive the locking means (c).

Preferably, the locking means (c) may consist essentially of a locking-bolt.

The first member (a) and the second member (b) may suitably each be made of a metal, for example iron or steel (which may optionally be hardened).

Preferably, each of the recesses in the first member (a) and second member (b) is provided with a lining of a resilient material, to minimise damage to the firearm.

The lining may comprise a rubber or a rubber-like material.

Alternatively, the lining may comprise a foam material.

A device according to the present invention may also include reinforcing means (for example a means which, in use, acts as a back-plate) to secure the first member (a) to the substrate.

In accordance with the second aspect of the present invention, a firearms security system may comprise two or more first members (a) and one or more second members (b), together with at least one locking means (c), each of the first members (a) being substantially permanently attached to a substrate and the second member (b) being adapted to be transferred, together with the firearm and the locking means (c), from one first member (a) to a further first member (a).

The substrate may be, or may be substantially permanently associated with, a surface of a building.

Alternatively, the substrate may be, or may be substantially permanently associated with, a surface of a vehicle.

Thus, a system according to the second aspect of the present invention may comprise three first members (a), one second member (b) and one locking means (c). One of the first members (a) may be secured, for example, to a surface of the owner's residence. Another of the first members (a) may be secured to a surface of a motor vehicle (e.g. the floor of the vehicle) and the remaining first member (a) may be secured to a surface of the premises of a gun-club. The owner can, therefore, transport his firearm from a retaining device in his residence, via a retaining device in a motor vehicle, to a retaining device on the premises of a gun-club, by releasing the second member (b) from the first member (a) in his residence and attaching the second member (b) (and firearm) to the first member in his vehicle, followed by correspondingly removing the second member (b) (and firearm) from the vehicle and attaching some to the first member (a) in the club premises.

A preferred embodiment of the present invention will be illustrated, merely by way of example, in the following description and with reference to the accompanying drawings:

In the drawings (wherein like numerals denote like parts):

Figure 1:
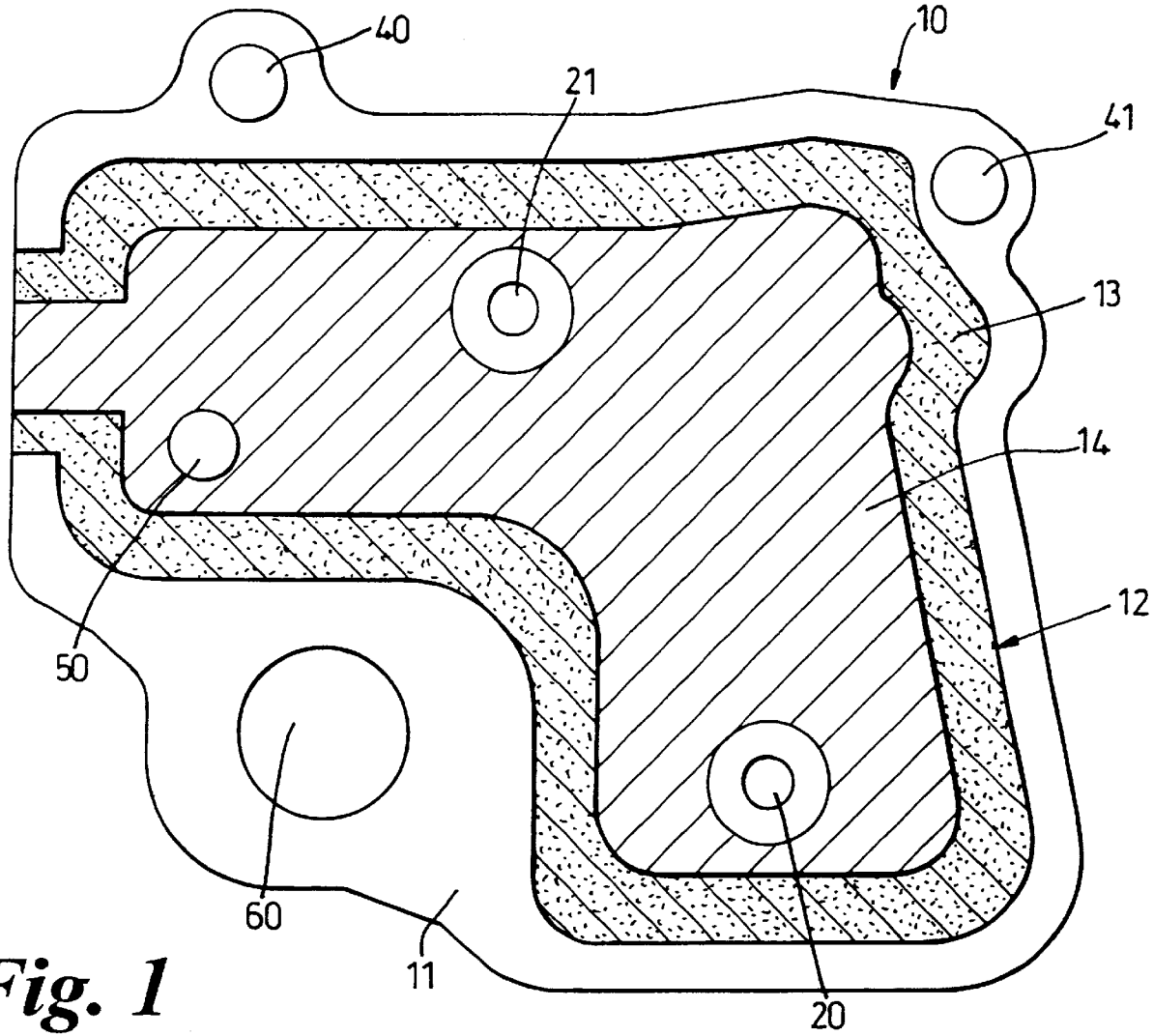
FIG. 1 is a plan view of the first member (a) of a device according to the present invention.
Figure 2:
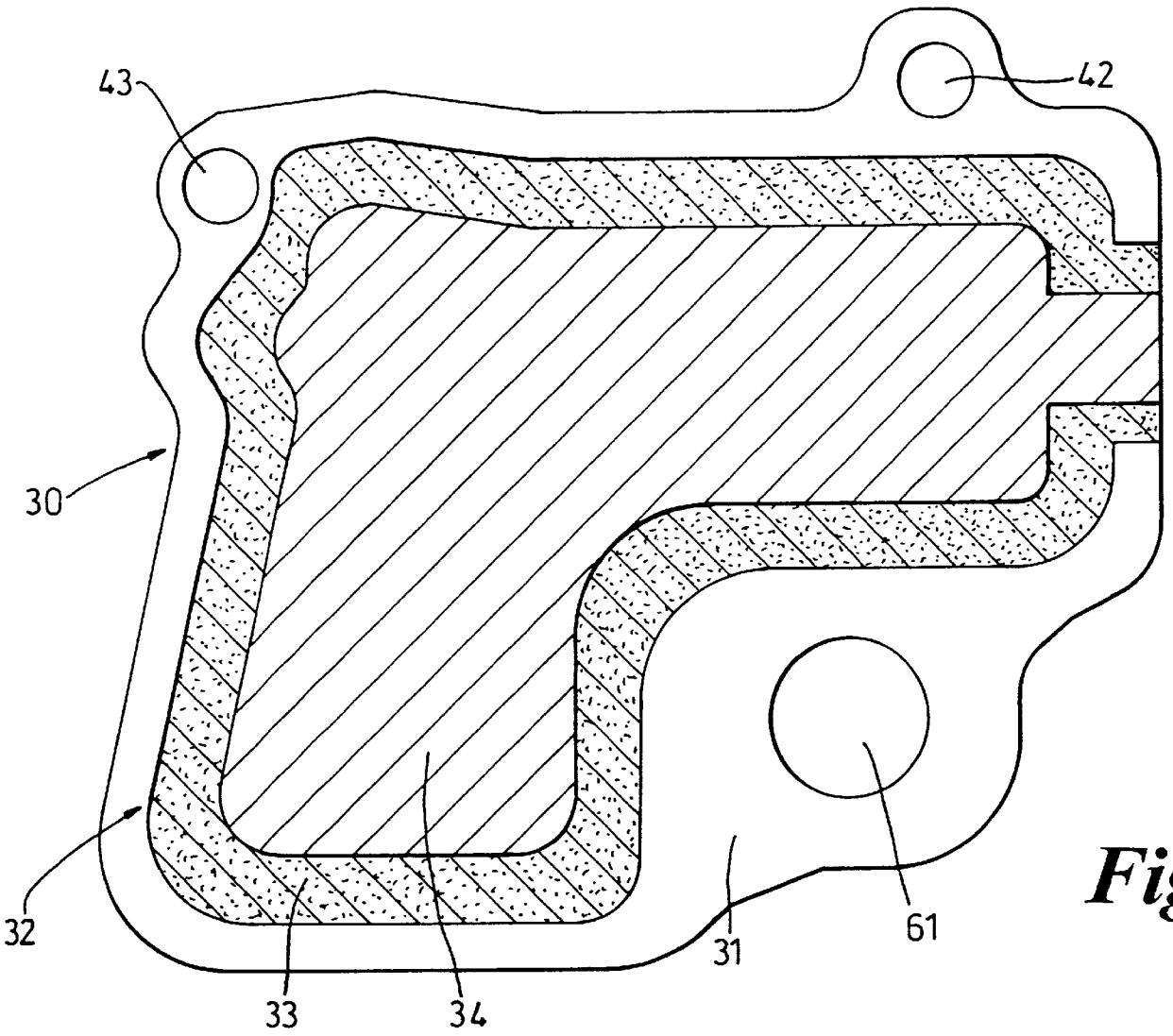
FIG. 2 is a plan view of the second member (b) to be associated with the first member (a) of FIG. 1.
Figure 3:
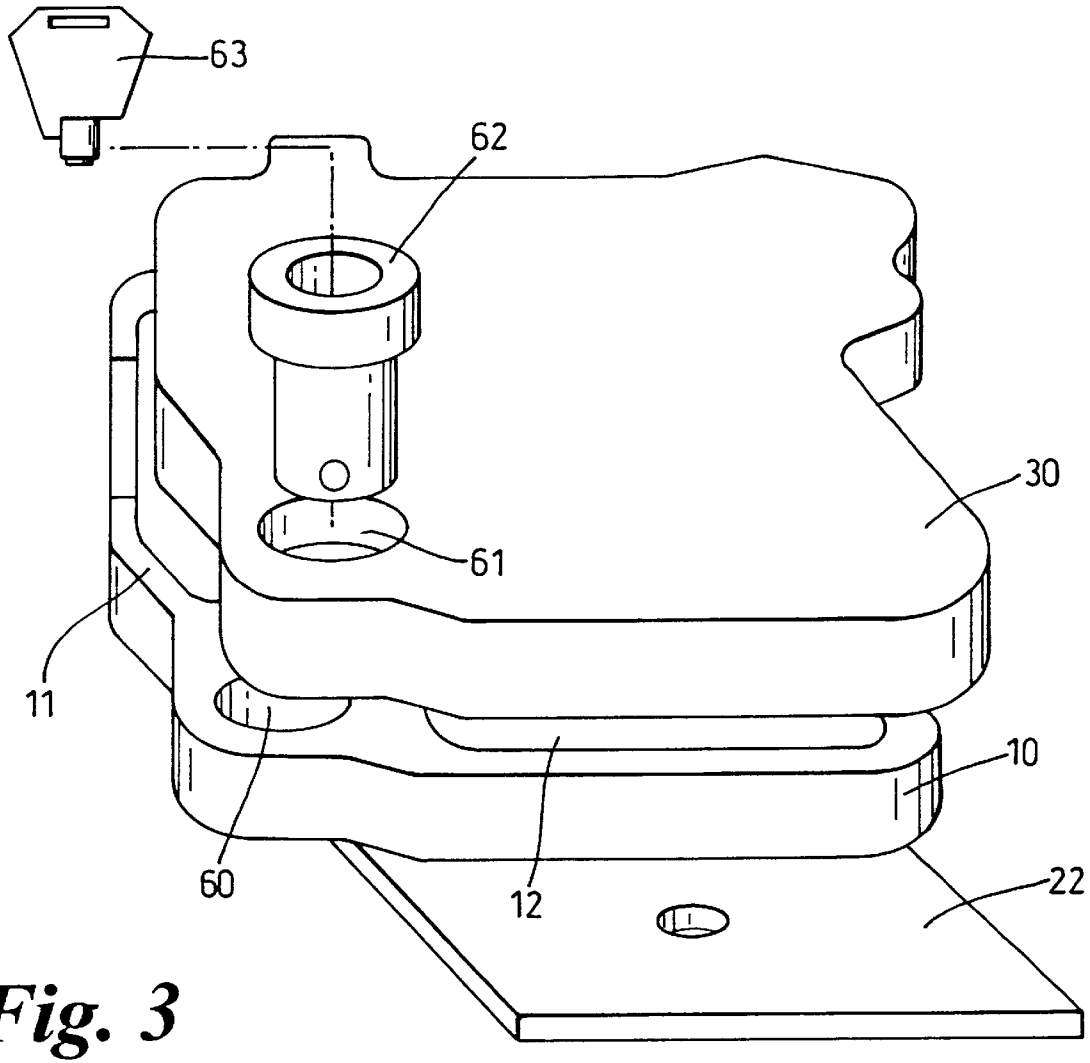
FIG. 3 shows the method of assembly of the members (a) and (b) of FIGS. 1 and 2 respectively.

Referring now to FIGS. 1, 2 and 3, the first member (a) comprises a sheet or slab 10 made of steel. On the face 11 there is provided a recess 12 to receive at least part of a firearm (not shown). The recess is provided with through-holes 20 and 21 for attachment to a substrate via a backing-plate 22.

The second member (b) likewise comprises a sheet or slab 30, made of steel and provided on its face 31 with a corresponding recess 32. The recesses 12 and 32 are each provided with a resilient edging (13 and 33 respectively) and a resilient lining (14 and 34 respectively) to minimise possible damage to the firearm.

The first member (a) is provided with hardened-steel pins 40 and 41 extending substantially at right angles to the plane of the face 11. The pins 40 and 41 are received in corresponding holes, 42 and 43 respectively, provided in the second member (b).

The first member (a) is further provided with a pin 50 to act as a trigger-guard for the firearm when the device is in use.

Finally, the first member (a) and second member (b) are each provided with holes 60 and 61 respectively, to receive a locking means 62 operable by way of a key 63.

Figure 4:
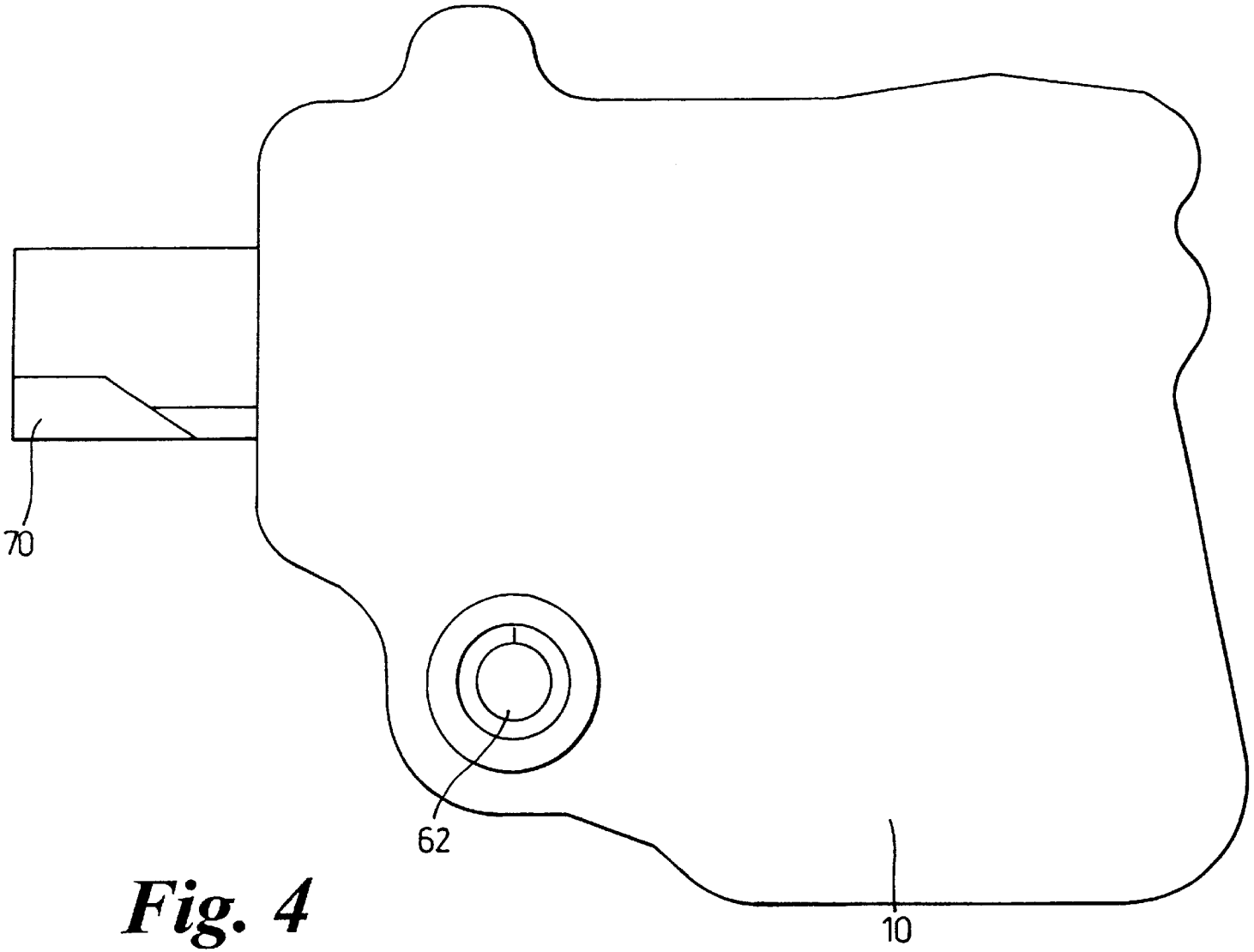
FIG. 4 shows a device according to the present invention, in use in association with a hand-gun.
Figure 5:
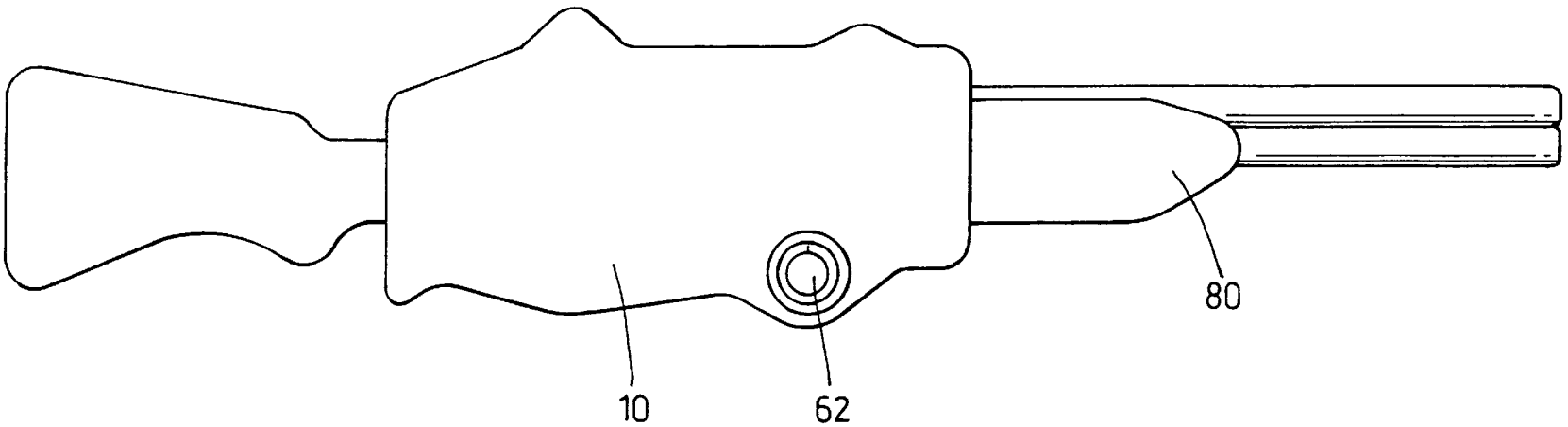
FIG. 5 shows a device according to the present invention, in use in association with a shot-gun.

In FIG. 4, a device according to the present invention is shown in association with a hand-gun 70 and in FIG. 5, the device is shown in association with a shot-gun 80. In each instance, the firearm is secured against unauthorised tampering whilst it is locked inside the device.

What is claimed is:

1. A firearms security system, said system comprising at least one retention device for a firearm, said at least one retention device comprising:

a first member adapted, in use, to be substantially permanently attached to a substrate;

a second member adapted, in use, to be operatively engageable with said first member, whereby said first and second members define between them a cavity to receive said firearm;

locking means adapted, in use, to lock together said first and second members, whereby said firearm is retained in said cavity; wherein said system comprises at least two of said first members and at least one of said second members, together with at least one of said locking means, each of said first members being substantially permanently attached to a substrate and said second member being adapted to be transferred, together with said firearm and said locking means, from one of said at least two first members to a further one of said at least two first members.

2. The system of claim 1, wherein said first member (a) and said second member (b) each consist essentially of a sheet of a rigid material having, on one face thereof, a recess adapted to receive at least part of said firearm, whereby, when said first member (a) is in operative engagement with said second member (b), said recesses co-operate to define said cavity to receive said firearm.

3. The system of claim 1, wherein said first member (a) is provided with at least one locating pin and said second member (b) is provided with at least one corresponding aperture to receive said at least one pin when said first member (a) and said second member (b) are brought into operative engagement.

4. The system of claim 1, wherein said second member (b) is provided with at least one locating pin and said first member (a) is provided with at least one corresponding aperture to receive said at least one pin when said first member (a) and said second member (b) are brought into operative engagement.

5. The system of claim 3, wherein one of said at least one location pins is adapted, in use, to function as a trigger-guard for said firearm.

6. The system of claim 1, wherein said device includes means, additional to said locking means (c), adapted, in use, to secure said firearm to said second member (b).

7. The system of claim 1, wherein each of said first member (a) and said second member (b) is provided with a mortice or other aperture to receive said locking means (c).

8. The system of claim 7, wherein said locking means (c) consists essentially of a locking-bolt.

9. The system of claim 1, wherein each of said first member (a) and said second member (b) is made of a metal.

10. The system of claim 9, wherein said metal is selected from the group consisting of iron, steel, hardened iron and hardened steel.

11. The system of claim 2, wherein each said recess is provided with a lining of a resilient material.

12. The system of claim 11, wherein said lining consists essentially of a material selected from the group consisting of rubbers, rubber-like materials and foam materials.

13. The system of claim 1, wherein said device also includes reinforcing means for use in attaching said first member (a) to said substrate.

14. The system of claim 13, wherein said reinforcing means acts, in use, as a back-plate for said first member (a).

15. The system of claim 1, wherein said substrate is, or is substantially permanently associated with, a surface of a building.

16. The system of claim 1, wherein said substrate is, or is substantially permanently associated with, a surface of a vehicle.

17. The system of claim 4, wherein one of said at least one location pins is adapted, in use, to function as a trigger-guard for said firearm.

18. The system of claim 1, wherein said first member is provided with a pin, said pin acting as a trigger-guard when said at least one retention device is in use.

19. A firearms security system comprising:

at least two first members adapted, in use, to be substantially permanently attached to a substrate;

a second member adapted, in use, to be operatively engageable with each said first member, whereby said first and each said second member define between them a cavity to receive said firearm, said second member being adapted to be transferred together with said firearm from one of said at least two first members to a further one of said at least two first members, said second member ddefining a guard to prevent said firearm from discharging when transferred in combination with said firearm; and a locking means adapted, in use, to lock together said first and each sid second members, whereby said firearm is retained in said cavity.

* * * * *